US010502102B1

(12) United States Patent
Hofer

(10) Patent No.: US 10,502,102 B1
(45) Date of Patent: Dec. 10, 2019

(54) ACTUATION ARRANGEMENT FOR A SWITCHABLE LEVER

(71) Applicant: Schaeffler Technologies AG & Co. KG, Herzogenaurach (DE)

(72) Inventor: Béla Hofer, Royal Oak, MI (US)

(73) Assignee: SCHAEFFLER TECHNOLOGIES AG & CO. KG, Herzogenaurach (DE)

( * ) Notice: Subject to any disclaimer, the term of this patent is extended or adjusted under 35 U.S.C. 154(b) by 0 days.

(21) Appl. No.: 16/030,914

(22) Filed: Jul. 10, 2018

(51) Int. Cl.

| | |
|---|---|
| ***F01L 1/20*** | (2006.01) |
| ***F01L 13/00*** | (2006.01) |
| ***F01L 1/22*** | (2006.01) |
| ***F01L 1/18*** | (2006.01) |

(52) U.S. Cl.
CPC ..... *F01L 13/0005* (2013.01); *F01L 1/185* (2013.01); *F01L 1/20* (2013.01); *F01L 1/22* (2013.01); *F01L 2109/00* (2013.01)

(58) Field of Classification Search
CPC ..... F01L 1/12; F01L 1/18; F01L 1/185; F01L 1/20; F01L 1/22; F01L 13/0005; F01L 13/0063; F01L 2105/00; F01L 2109/00
USPC ..... 123/90.43, 90.45, 90.52
See application file for complete search history.

(56) References Cited

U.S. PATENT DOCUMENTS

| | | | | |
|---|---|---|---|---|
| 6,708,660 | B2 * | 3/2004 | Seitz | F01L 1/18 123/198 F |
| 6,976,461 | B2 * | 12/2005 | Rorig | F01L 13/0005 123/90.15 |
| 7,377,247 | B2 * | 5/2008 | Seitz | F01L 1/185 123/90.16 |
| 8,267,059 | B2 * | 9/2012 | Manther | F01L 1/185 123/90.16 |
| 8,434,440 | B2 * | 5/2013 | Manther | F01L 13/0021 123/90.16 |
| 9,021,996 | B2 * | 5/2015 | Manther | F01L 1/181 123/90.16 |
| 9,988,947 | B2 | 6/2018 | Haefner | |
| 10,196,944 | B2 * | 2/2019 | Evans | F01L 1/185 |
| 2004/0069258 | A1 | 4/2004 | Kaczmarek et al. | |
| 2005/0092273 | A1 | 5/2005 | Cecur et al. | |

FOREIGN PATENT DOCUMENTS

| | | | |
|---|---|---|---|
| WO | 2017144706 | A1 | 8/2017 |
| WO | 2017202845 | A1 | 11/2017 |

* cited by examiner

*Primary Examiner* — Adam D Rogers
(74) *Attorney, Agent, or Firm* — Matthew V. Evans

(57) ABSTRACT

A switchable lever is provided that includes an outer lever, an inner lever pivotably mounted to the outer lever, and a lash adjustable coupling assembly capable of selectively locking the inner lever to the outer lever. The lash adjustable coupling assembly includes an inner rod and an outer cylinder configured to adjustably receive the inner rod. The inner rod can be formed with external threads and the outer cylinder can be formed with internal threads. A lash adjustment spring can be arranged to outwardly urge the inner rod with respect to the outer rod to adjust lash within a switchable lever system.

20 Claims, 6 Drawing Sheets

ACTUATION ARRANGEMENT FOR A SWITCHABLE LEVER

TECHNICAL FIELD

This invention is generally related to levers, and, more particularly, to switchable levers utilized within a valve train of an internal combustion (IC) engine.

BACKGROUND

Levers are utilized within valve trains of IC engines to facilitate translation of rotary motion of a camshaft to linear motion of an intake or exhaust valve. Switchable levers can include a coupling assembly that can couple or uncouple an inner lever to an outer lever to achieve different discrete valve lifts. The coupling assembly can be actuated by hydraulic fluid which can require a series of hydraulic fluid galleries arranged throughout an engine. The coupling pin can also be actuated by an electric actuator. Use of an electric actuator instead of actuation by hydraulic fluid can offer several advantages including, but not limited to, wider operating temperature range, elimination of hydraulic fluid oil galleries, and faster actuation times. Packaging space within an IC engine can be very limited for switchable lever systems.

SUMMARY

A switchable lever is provided that includes an outer lever, an inner lever pivotably mounted to the outer lever, and a lash adjustable coupling assembly capable of selectively locking the inner lever to the outer lever. The lash adjustable coupling assembly includes an inner rod and an outer cylinder configured to adjustably receive the inner rod. A first end of the inner rod is configured to receive an external force. The external force can be provided by an actuator. The outer cylinder can be formed with internal threads and the inner rod can be formed with external threads. A lash adjustment spring, optionally located between a first end of the inner rod and a first end of the outer cylinder, can be arranged to outwardly urge the inner rod with respect to the outer cylinder. The outer cylinder can move within a bore arranged transverse to the switchable lever. Upon receiving the external force, the outer cylinder can actuate a coupling pin that is formed with a first locking surface. A second end of the outer cylinder can be configured to actuate a second switchable lever. In an example embodiment, a second end of the outer cylinder can be formed with the first locking surface that engages with a second locking surface during a valve lift event, the second locking surface formed on a lost motion end of the inner lever.

A switchable lever system is provided that includes a first outer lever, a first inner lever pivotably mounted to the first outer lever, and a first lash adjustable coupling assembly capable of selectively locking the first inner lever to the first outer lever. The first lash adjustable coupling assembly has a first inner rod and a first outer cylinder arranged to adjustably receive the first inner rod. A first end of the first inner rod is actuated by an actuator. The first outer cylinder can be formed with internal threads and the first inner rod can be formed with external threads. An optional first lash adjustment spring can be arranged to outwardly urge the first inner rod with respect to the first outer cylinder. The switchable lever system can include a second switchable lever that includes a second outer lever, a second inner lever pivotably mounted to the second outer lever, and a second lash adjustable coupling assembly capable of selectively locking the second inner lever to the second outer lever. The second lash adjustable coupling assembly has a second inner rod and a second outer cylinder arranged to adjustably receive the second inner rod. A first end of the second inner rod can be actuated by a second end of the first outer cylinder of the first switchable lever. Therefore, the actuator can move the first and second lash adjustable coupling assemblies to a first, locked position and to a second, unlocked position. The second outer cylinder can be formed with internal threads, and the second inner rod can be formed with external threads. An optional second lash adjustment spring can be arranged to outwardly urge the second inner rod with respect to the second outer cylinder. The second lash adjustment spring can be arranged between a first end of the second inner rod and a first end of the second outer cylinder. A protrusion length of the second inner rod can be limited by a position of the first outer cylinder of the first switchable lever.

A method of adjusting coupling assembly lash in a switchable lever system is provided that includes: (1) rotating a first inner rod formed with external threads within a first outer cylinder formed with internal threads; the first outer cylinder disposed within a bore of a first switchable lever; and, (2) setting a lash between a first end of the first inner rod and an actuator to a pre-determined value. The rotating step included in (1) can be accomplished by a first lash adjustment spring that urges the first inner rod to rotate relative to the first outer cylinder, increasing a first protrusion length of the first inner rod relative to the first outer cylinder. The previously described method of adjusting coupling assembly lash can also include steps for inclusion of a second switchable lever, including: (3) rotating a second inner rod formed with external threads within a second outer cylinder formed with internal threads, the second outer cylinder disposed within a bore of a second switchable lever; and, (4) setting a lash between a first end of the second inner rod and a second end of the first outer cylinder to a pre-determined value. The rotating step included in (3) can be accomplished by a second lash adjustment spring that urges the second inner rod to rotate relative to the second outer cylinder, increasing a second protrusion length of the second inner rod relative to the second outer cylinder.

BRIEF DESCRIPTION OF THE DRAWINGS

The above mentioned and other features and advantages of the embodiments described herein, and the manner of attaining them, will become apparent and better understood by reference to the following descriptions of multiple example embodiments in conjunction with the accompanying drawings. A brief description of the drawings now follows.

DETAILED DESCRIPTION OF THE EMBODIMENTS

Figure 1:
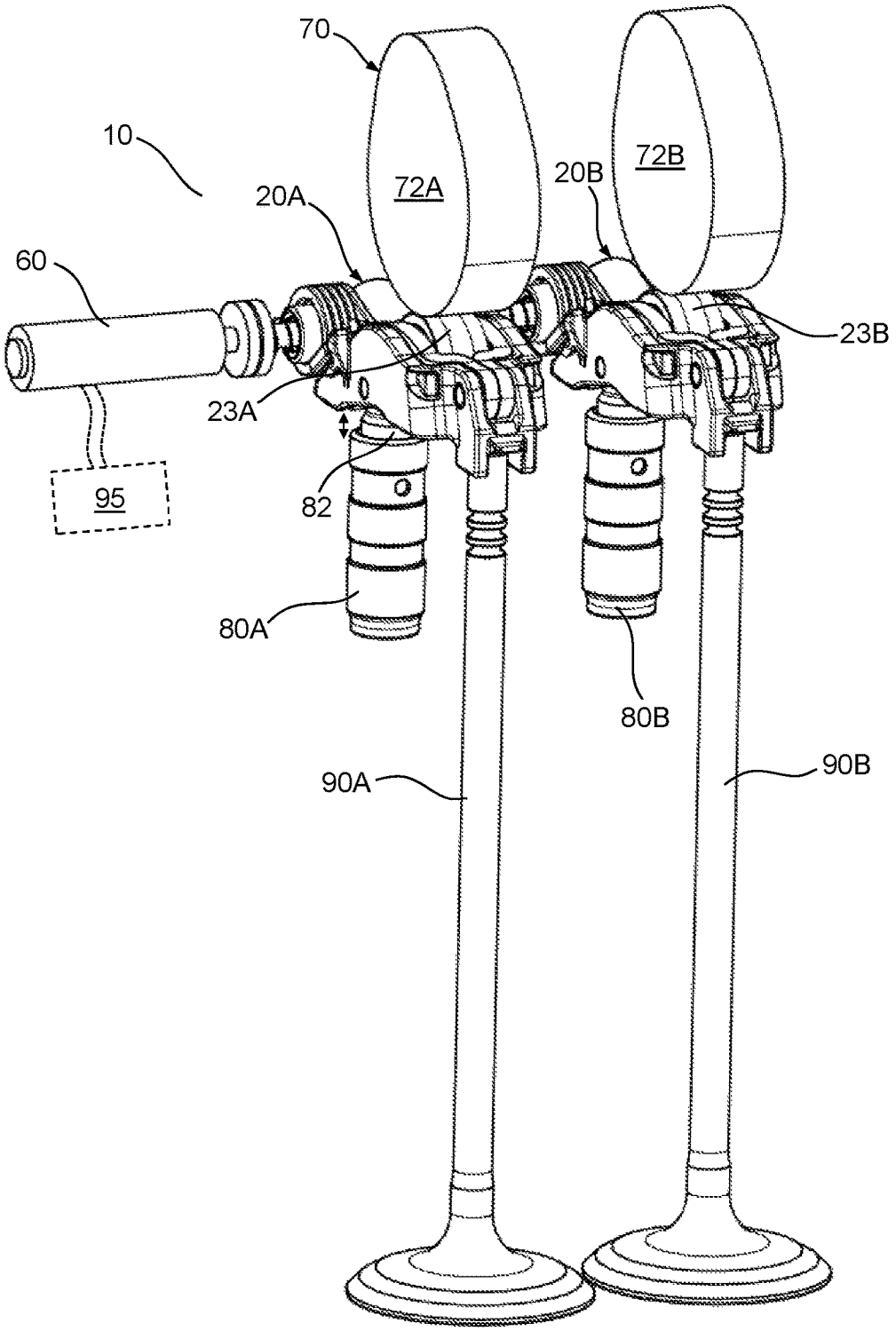
FIG. 1 is a perspective view of a valve train system for an IC engine that includes a camshaft, first and second hydraulic lash adjusters, first and second engine valves, an actuator, an optional electronic controller, and a first and a second switchable lever.

Identically labeled elements appearing in different figures refer to the same elements but may not be referenced in the description for all figures. The exemplification set out herein illustrates at least one embodiment, in at least one form, and such exemplification is not to be construed as limiting the scope of the claims in any manner. Certain terminology is used in the following description for convenience only and is not limiting. The words "inner," "outer," "inwardly," and "outwardly" refer to directions towards and away from the parts referenced in the drawings. Axially refers to directions along a diametric central axis. Radially refers to directions that are perpendicular to the central axis. The words "left", "right", "up", "upward", "down", and "downward" designate directions in the drawings to which reference is made. The terminology includes the words specifically noted above, derivatives thereof, and words of similar import.

Referring to FIG. 1, a perspective view of a first switchable lever 20A and a second switchable lever 20B are shown within a valve train system 10 of an IC engine (not shown). The valve train system 10 also includes an actuator 60, a camshaft 70 with first and second lobes 72A, 72B, a first hydraulic pivot element 80A, a second hydraulic pivot element 80B, a first engine valve 90A, and a second engine valve 90B. The actuator 60 can be that of an electric actuator and can be controlled by and communicate electronically with an optional electronic controller 95. The camshaft 70 rotationally actuates the first and second switchable levers 20A, 20B through respective first and second rollers 23A, 23B about the first and second hydraulic pivot elements 80A, 80B, causing rotational motion provided by the camshaft 70 to be translated to linear motion of the first and second engine valves 90A, 90B. A single "valve event" is facilitated by one rotation of the camshaft 70, encompassing opening and closing of the first and second engine valves 90A, 90B.

The actuator 60 can have many different forms and configurations. The term "actuator" is used throughout the specification and claims and is intended to define a component, or assembly of components that actuates the first and/or second switchable levers 20A, 20B.

Referring now to FIGS. 1 through 7B, a detailed explanation of the design and function now follows for the first switchable lever 20A, which can also be applicable to the second switchable lever 20B. The first switchable lever 20A includes an inner lever 22 pivotably connected to an outer lever 24 by a pivot axle 26. The outer lever 24 has two outer arms 29A, 29B that extend along longitudinal sides 27A, 27B of the inner lever 22. A cavity 21 within the inner lever 22 houses the first roller 23A that interfaces with the camshaft 70 shown in FIG. 1. The first roller 23A is connected to the inner lever 22 via a transverse axle pin 31 disposed within two axle apertures (not shown) of the inner lever 22. Optional needle rollers 44 can be arranged between the first roller 23A and the axle pin 31. Lost motion resilient elements or springs 28A, 28B are arranged on respective lost motion spring posts 39A, 39B of the outer lever 24. The lost motion springs 28A, 28B are arranged to apply an upward force against lost motion spring landings 41A, 41B located on the inner lever 22 to bias the first roller 23A of the inner lever 22 to an upper-most position.

Figure 4A:
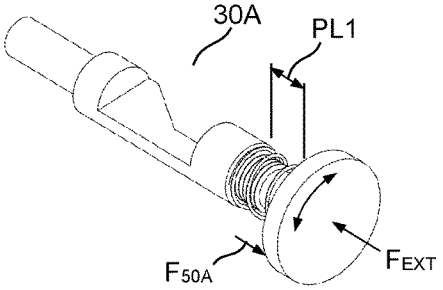
FIG. 4A is perspective view of an example embodiment of a lash adjustable coupling assembly.
Figure 4B:
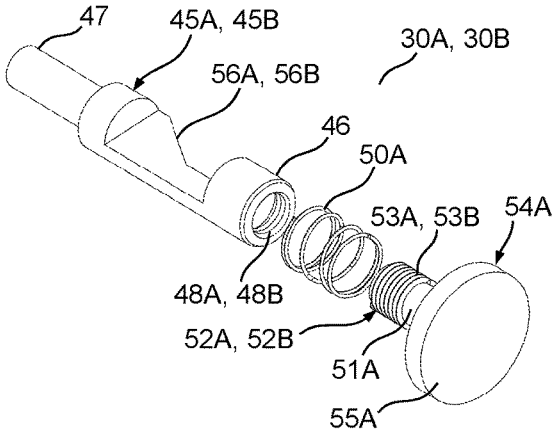
FIG. 4B is an exploded perspective view of a lash adjustable coupling assembly.
Figure 7A:
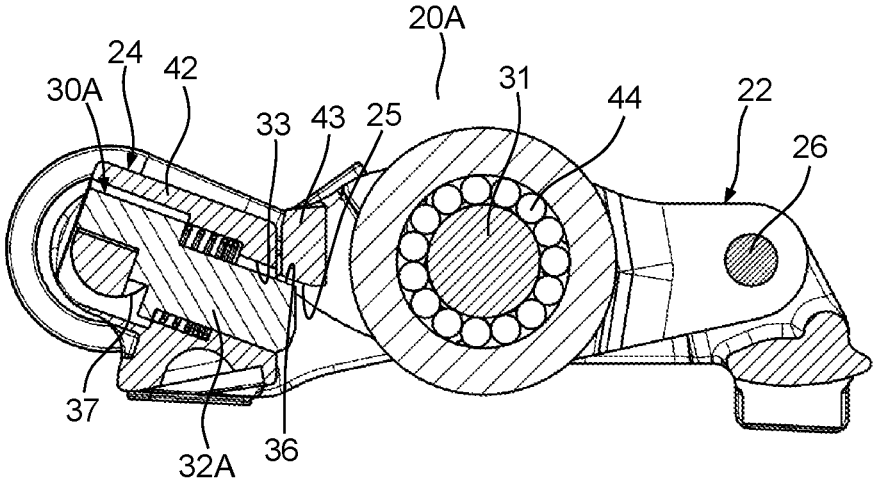
FIG. 7A is a cross-sectional view of the first switchable lever of FIG. 3 in a first, locked position.
Figure 7B:
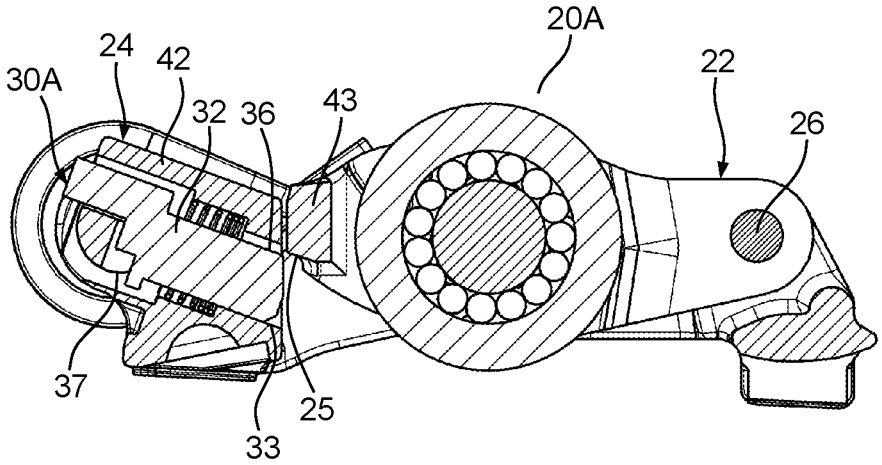
FIG. 7B is a cross-sectional view of the first switchable lever of FIG. 3 in a second, unlocked position.

Now referring to FIGS. 7A and 7B with view to FIGS. 4A and 4B, a locking end 42 of the outer lever 24 is configured with a first lash adjustable coupling assembly 30A that can selectively lock the inner lever 22 to the outer lever 24, achieving at least two valve lift modes. A first, locked position of the first lash adjustable coupling assembly 30A is shown in FIG. 7A and a second, unlocked position of the first lash adjustable coupling assembly 30A is shown in FIG. 7B. The first lash adjustable coupling assembly 30A includes a first outer cylinder 45A that moves within a bore 37 that is arranged transverse to the first switchable lever 20A. The first outer cylinder 45A can be configured with a first wedge form 56A that interfaces with a first coupling pin wedge form 57 (shown in FIG. 5B) of a first coupling pin 32A to actuate the first coupling pin 32A within a coupling pin bore 33 to selectively lock the inner lever 22 to the outer lever 24. A coupling pin bias spring 58 is shown that can be arranged to help properly position the first coupling pin 32A to a desired position, such as either of the first, locked or second, unlocked positions. Many forms of the first outer cylinder 45A and the first coupling pin 32A are possible to translate motion of the first outer cylinder 45A to motion of the first coupling pin 32A. The first outer cylinder 45A is formed with internal threads 48A to adjustably receive a first inner rod 52A that is formed with external threads 53A. A first protrusion length PL1 of the first inner rod 52A relative to the first outer cylinder 45A can be controlled by rotating the first inner rod 52A either clockwise or counterclockwise, as shown in FIG. 4A. A first end 51A of the first inner rod 52A receives an external force FEXT to actuate the first lash adjustable coupling assembly 30A. The external force FEXT can be provided from the actuator 60 or any other source that provides a force to move the first lash adjustable coupling assembly 30A.

Figure 2:
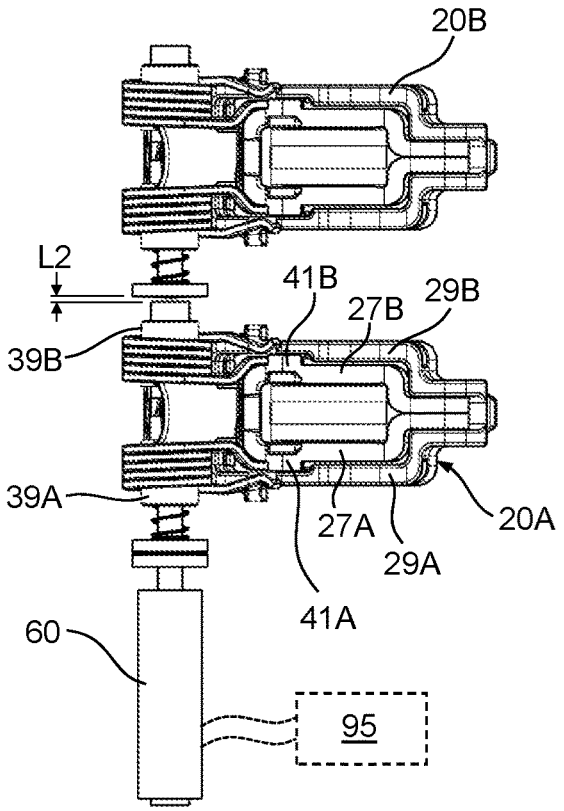
FIG. 2 is a top view of the valve train system of FIG. 1 without the camshaft and engine valves.
Figure 3:
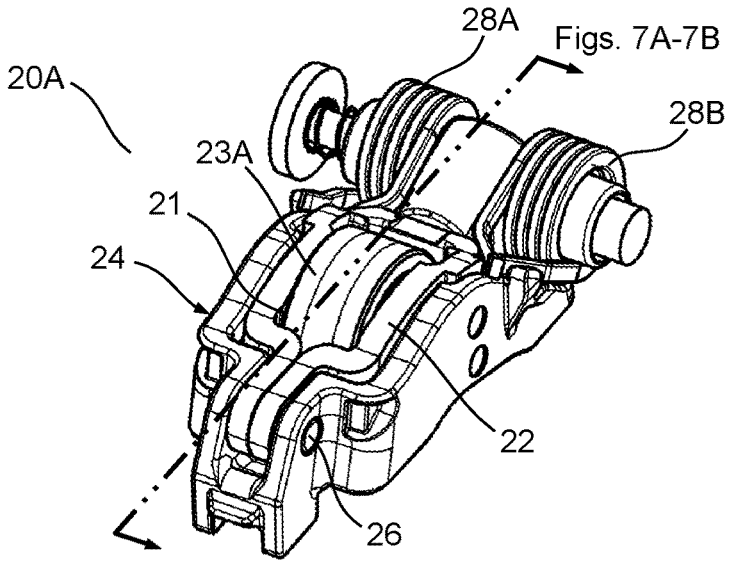
FIG. 3 is a perspective view of the first switchable lever of FIG. 1.
Figure 5A:
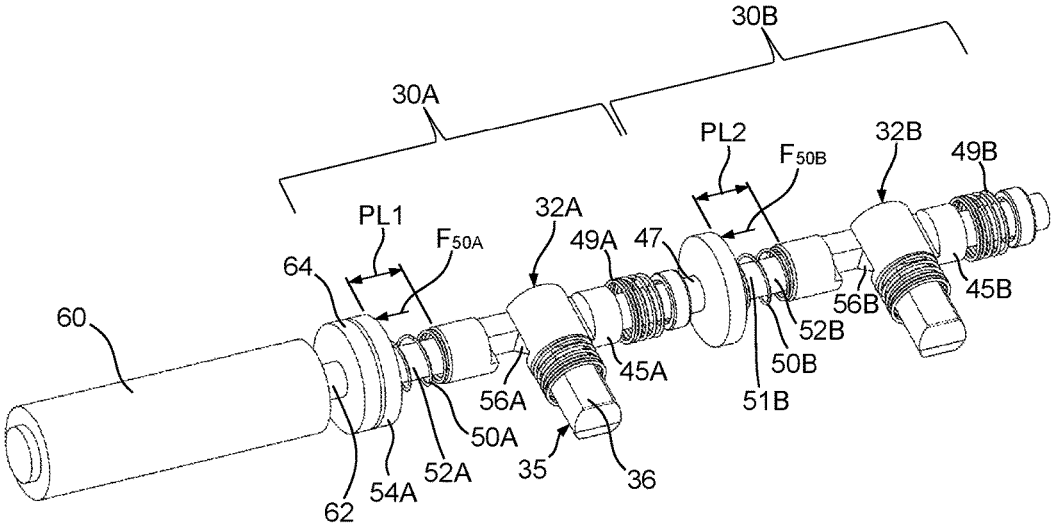
FIG. 5A is a perspective view of an example embodiment of an actuator together with a first and a second lash adjustable coupling assembly.
Figure 5B:
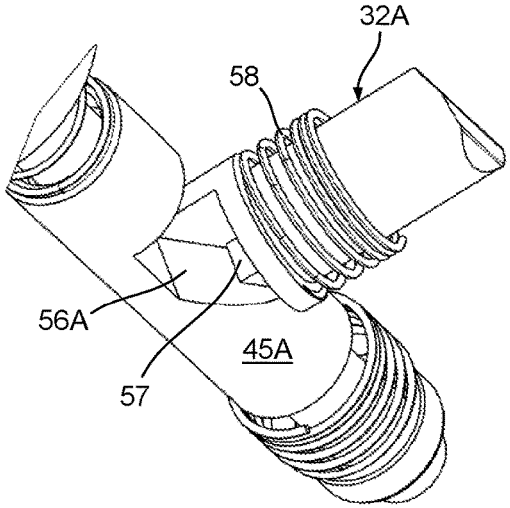
FIG. 5B is a detailed perspective view of an underside of a portion of the first lash adjustable coupling assembly of FIG. 5A.
Figure 6A:
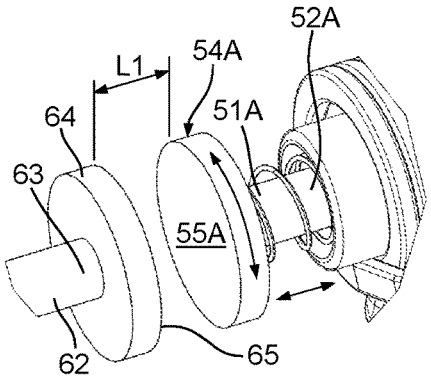
FIGS. 6A and 6B are detailed perspective views that pictorially show adjustment of a first lash between the first lash adjustable coupling assembly and the actuator of FIG. 5A.
Figure 6B:
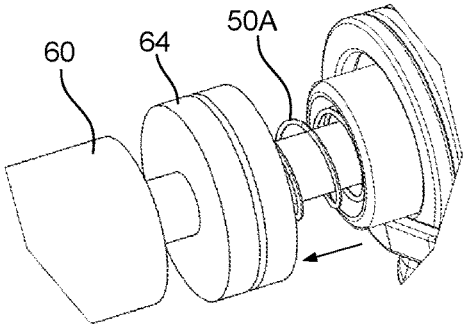

Referring now to FIG. 5A with view to FIGS. 2 and 4B, the actuator 60 is shown together with the first lash adjustable coupling assembly 30A for the first switchable lever 20A and a second lash adjustable coupling assembly 30B for the second switchable lever 20B. The second lash adjustable coupling assembly 30B is a duplicate of the previously described first lash adjustable coupling assembly 30A, however, different forms for the first and second lash adjustable coupling assemblies 30A, 30B are also possible. The second lash adjustable coupling assembly 30B includes a second outer cylinder 45B that moves within a bore (not shown, but identical to the bore 37 shown in FIGS. 7A and 7B for the first switchable lever 20A) arranged transverse to the second switchable lever 20B. The second outer cylinder 45B can be configured with a second wedge form 56B that interfaces with a mating wedge form (not shown) of the second coupling pin 32B, to actuate the second coupling pin 32B within a coupling pin bore (not shown) to achieve locked and unlocked modes for the second switchable lever 20B. The second inner rod 52B is formed with external threads 53B, and the second outer cylinder 45B is formed with internal threads 48B to adjustably receive the external threads 53B of the second inner rod 52B. A second protrusion length PL2 of the second inner rod 52B relative to the second outer cylinder 45B can be controlled by rotating the second inner rod 52B either clockwise or counterclockwise.

FIG. 5A's arrangement shows that a single actuator 60 with a single actuator pin 62 can actuate both the first and second lash adjustable coupling assemblies 30A, 30B of the respective first and second switchable levers 20A, 20B. A first outer cylinder bias spring 49A and a second outer cylinder bias spring 49B can be arranged to help position the first and second outer cylinders 45A, 45B. Due to manufacturing tolerances of a receiving structure such as an engine cylinder head, the location of the components of FIG. 1 can vary; furthermore, due to manufacturing tolerances of each individual component assembly, the locations of component features can also vary. Given such tolerances and potential wear amongst components, a magnitude of a first clearance or lash L1 between the actuator 60 and the first lash adjustable coupling assembly 30A (see FIG. 6A) and a magnitude of a second clearance or lash L2 between the first and second lash adjustable coupling assemblies 30A, 30B (see FIG. 2) can have a functional effect on the operation of the first and second switchable levers 20A, 20B.

The first lash L1 can be described as a clearance or gap between the first end 51A of the first inner rod 52A and an engaging end 63 of the actuator 60. The second lash L2 can be described as a clearance or gap between a second end 47 of the first outer cylinder 45A and a first end 51B of the second inner rod 52B. Control of the first and second lashes L1, L2 can be achieved through adjustment of the previously described respective first and second protrusion lengths PL1, PL2 of the respective first and second lash adjustable coupling assemblies 30A, 30B. The adjustment of the first and second protrusion lengths PL1, PL2 can be accomplished in two ways: 1). Manual rotation of the first and second inner rods 52A, 52B relative to respective first and second outer cylinders 45A, 45B; this manual rotation can be accomplished by hand or tool, or any other means that applies a rotational force to the first and second inner rods 52A, 52B; and, 2). Induced rotation of the first and second inner rods 52A, 52B relative to respective first and second outer cylinders 45A, 45B. An optional first lash adjustment spring 50A can be arranged between the first end 51A of the first inner rod 52A and a first end 46 of the first outer cylinder 45A. The first lash adjustment spring 50A outwardly urges the first inner rod 52A with a first urging force $F_{50A}$ that acts upon the first end 51A of the first inner rod 52A. The first urging force $F_{50A}$ acts to increase the first protrusion length PL1 of the first lash adjustable coupling assembly 30A by causing the first inner rod 52A to unscrew from the first outer cylinder 45A. Likewise, an optional second lash adjustment spring 50B can be arranged between the second inner rod 52B and the second outer cylinder 45B such that a second urging force $F_{50B}$ acts upon the first end 51B of the second inner rod 52B. The second urging force $F_{50B}$ acts to increase the second protrusion length PL2 of the second lash adjustable coupling assembly 30B by causing the second inner rod 52B to unscrew from the second outer cylinder 45B.

The first described method of adjusting the first and second protrusion lengths PL1, PL2 can be applied or utilized during an engine assembly process or at maintenance intervals for the engine. For example, in cases of component wear, first and second protrusion lengths PL1, PL2 can be adjusted to achieve a predetermined lash value, possibly within a range of acceptable lash values, for the first and second lashes L1, L2. The predetermined lash value can be zero or greater. Similar to adjusting engine valve lash between an engine valve tip and corresponding valve train component within a mechanical valve train system, the first and/or second lashes L1, L2 may be greater than zero to accommodate thermal growth or wear conditions that could occur and result in an undesirable pre-loaded condition amongst the actuator 60 and one or more adjacent switchable levers.

The second described method of adjusting the first and second protrusion lengths PL1, PL2 can automatically occur during operation of the engine, and potentially eliminate any need to adjust the first and second lashes L1, L2 at prescribed maintenance intervals. The second method can continuously adjust the first and second protrusion lengths PL1, PL2 throughout a lifetime of an engine, or at least a lifetime of the first and second switchable levers 20A, 20B. This second method possibly adjusts the first and second lashes L1, L2 to a zero value. In this instance the first protrusion length PL1 can be limited by a location of the actuator 60, as the first inner rod 52A will be adjusted/unscrewed by the first lash adjustment spring 50A until it abuts with the actuator 60 or the actuator pin 62, if present.

Throughout their lifetime in an IC engine, the first and second hydraulic pivot elements 80A, 80B can function at many different heights or axial operating positions of a top plunger 82 (see FIG. 1). The different heights can be a result of, but not limited to, varying hydraulic fluid pressure, problematic operation, or wear that occurs within various valve train components. Enhanced or extended axial interfaces amongst the actuator 60 and the first and second lash adjustable coupling assembly 30A, 30B components can be utilized to counteract misalignment that can occur either due to positional tolerances of the various valve train components or varying operating heights of the first and second hydraulic pivot elements 80A, 80B. Referring to the first lash adjustable coupling assembly 30A of FIG. 4B, the first end 51A of the first inner rod 52A can have a first actuator landing 54A configured with a first landing face 55A. Now referring to FIGS. 5A and 6A, the engaging end 63 of the actuator pin 62 of the actuator 60 can have a push pad 64. The push pad 64 can be configured with a push pad face 65 that engages with the first landing face 55A of the first actuator landing 54A during an actuation event, even when misalignment occurs between the actuator pin 62 and the first inner rod 52A.

With reference to FIGS. 1 and 7A, the first coupling pin 32A is shown in the first, locked position in which the inner lever 22 and the outer lever 24 pivot in unison about the first hydraulic pivot element 80A, resulting in a first valve lift mode. The first coupling pin 32A has a coupling pin projection 35 that is formed with a first locking surface 36. The first, locked position is enabled when the actuator 60 is in an extended position such that the first locking surface 36 of the first coupling pin 32A engages with a second locking surface 25 on a lost motion end 43 of the inner lever 22 when the first switchable lever 20A is loaded during a valve event.

Now referencing FIGS. 1 and 7B, the coupling pin 32 is shown in the second, unlocked position. In this state, the inner lever 22 is allowed to rotate about the pivot axle 26 during each camshaft 70 rotation, resulting in an arcuate motion of the inner lever 22, often termed lost motion, while the outer lever 24 remains stationary. The second, unlocked position is enabled when the actuator 50 retracts the coupling pin 32 such that no portion of the first locking surface 36 of the coupling pin 32 can engage with the second locking surface 25 of the inner lever 22 during a valve lift event. The second, unlocked position facilitates a second valve lift mode.

Figure 8:
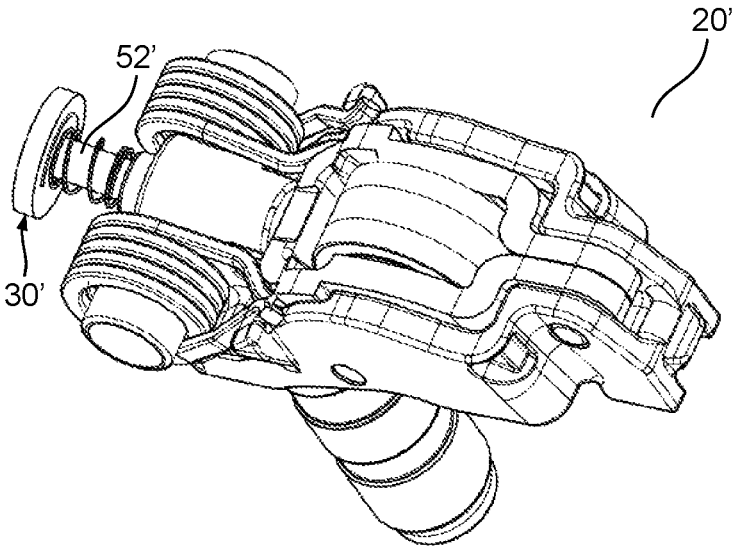
FIG. 8 is a perspective view of a switchable lever with an example embodiment of a lash adjustable coupling assembly.
Figure 9:
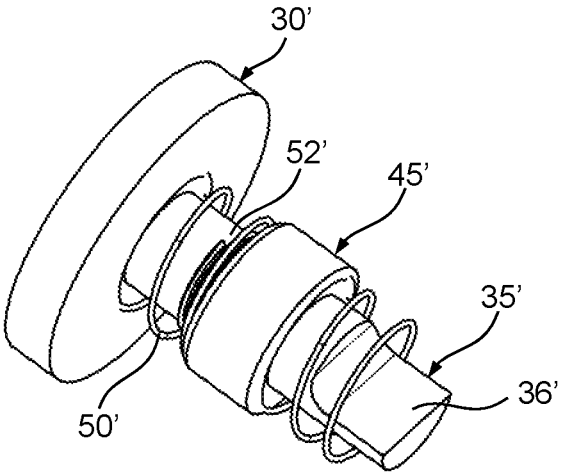
FIG. 9 is a perspective view of the lash adjustable coupling assembly of FIG. 8.

FIGS. 8 and 9 show another example embodiment of a lash adjustable coupling assembly 30' within a switching lever 20'. The lash adjustable coupling assembly 30' includes an inner rod 52', an outer cylinder 45' that adjustably receives the inner rod 52', and a lash adjustment spring 50'. Unlike the previously described first and second outer cylinders 45A, 45B shown in FIG. 5A, this embodiment of the outer cylinder 45' has a projection 35' configured with a first locking surface 36', thus eliminating the need for a coupling pin, such as the first and second coupling pins 32A, 32B of FIG. 5A.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A switchable lever comprising:
an outer lever;
an inner lever pivotably mounted to the outer lever; and
a lash adjustable coupling assembly capable of selectively locking the inner lever to the outer lever, the lash adjustable coupling assembly including:
an inner rod;
an outer cylinder configured to adjustably receive the inner rod, the outer cylinder having a first end and a second end; and
a first end of the inner rod configured to receive an external force.

2. The switchable lever of claim 1, wherein the outer cylinder is formed with internal threads and the inner rod is formed with external threads.

3. The switchable lever of claim 2, further comprising a lash adjustment spring arranged to outwardly urge the inner rod.

4. The switchable lever of claim 3, wherein the lash adjustment spring is arranged between the first end of the inner rod and a first end of the outer cylinder.

5. The switchable lever of claim 1, wherein the second end of the outer cylinder is formed with a first locking surface.

6. The switchable lever of claim 1, wherein the lash adjustable coupling assembly further comprises a coupling pin arranged to be actuated by the outer cylinder, the coupling pin formed with a first locking surface.

7. The switchable lever of claim 6, wherein the outer cylinder moves within a bore arranged transverse to the switchable lever.

8. The switchable lever of claim 7, wherein the second end of the outer cylinder is configured to actuate a second switchable lever.

9. A switchable lever system, comprising:
a first switchable lever, including:
a first inner lever;
a first outer lever pivotably mounted to the first inner lever;
a first lash adjustable coupling assembly capable of selectively locking the first inner lever to the first outer lever, the first lash adjustable coupling assembly having:
a first inner rod;
a first outer cylinder arranged to adjustably receive the first inner rod; and
a first end of the first inner rod actuated by an actuator.

10. The switchable lever system of claim 9, wherein the first outer cylinder is formed with internal threads and the first inner rod is formed with external threads.

11. The switchable lever system of claim 10, further comprising a first lash adjustment spring arranged to outwardly urge the first inner rod.

12. The switchable lever system of claim 9, further comprising a second switchable lever, the second switchable lever including:
a second outer lever;
a second inner lever pivotably mounted to the second outer lever;
a second lash adjustable coupling assembly capable of selectively locking the second inner lever to the second outer lever, the second lash adjustable coupling assembly having:
a second inner rod;
a second outer cylinder arranged to adjustably receive the second inner rod; and
a first end of the second inner rod actuated by a second end of the first outer cylinder.

13. The switchable lever system of claim 12, wherein the second outer cylinder is formed with internal threads and the second inner rod is formed with external threads.

14. The switchable lever system of claim 13, further comprising a lash adjustment spring arranged to outwardly urge the second inner rod.

15. The switchable lever system of claim 14, wherein a protrusion length of the second inner rod is limited by a position of the first outer cylinder of the first switchable lever.

16. The switchable lever system of claim 12, wherein at least one of the first lash adjustable coupling assembly or the second lash adjustable coupling assembly is moveable from a first, locked position to a second, unlocked position by the actuator.

17. A method of adjusting coupling assembly lash in a switchable lever system, comprising:
rotating a first inner rod formed with external threads within a first outer cylinder formed with internal threads, the first outer cylinder having a first end and a second end, and disposed within a bore of a first switchable lever; and setting a lash between a first end of the first inner rod and an actuator to a pre-determined value.

18. The method of claim 17, wherein the rotating step is accomplished by a first lash adjustment spring that urges the first inner rod to rotate relative to the first outer cylinder, increasing a first protrusion length of the first inner rod relative to the first outer cylinder.

19. The method of claim 17, further comprising:

rotating a second inner rod formed with external threads within a second outer cylinder formed with internal threads, the second outer cylinder disposed within a bore of a second switchable lever; and setting a lash between a first end of the second inner rod and the second end of the first outer cylinder to a pre-determined value.

20. The method of claim 19, wherein the step of rotating the second inner rod is accomplished by a lash adjustment spring that urges the second inner rod to rotate relative to the second outer cylinder, increasing a second protrusion length of the second inner rod relative to the first outer cylinder.

* * * * *